US005271322A

United States Patent [19]

Palma

[11] Patent Number: 5,271,322

[45] Date of Patent: Dec. 21, 1993

[54] DISPOSABLE POSTAGE STAMP MARKER

[76] Inventor: John Palma, 59-14 57th Rd., Maspeth, N.Y. 11378

[21] Appl. No.: 959,421

[22] Filed: Oct. 13, 1992

[51] Int. Cl.[5] ..... B41K 1/42

[52] U.S. Cl. ..... 101/333; 101/93; 101/93.47

[58] Field of Search ..... 101/91, 94, 93, 93.47, 101/333, 327, 334

[56] References Cited

U.S. PATENT DOCUMENTS

| | | | |
|---|---|---|---|
| 3,363,549 | 1/1968 | Reus | 101/91 |
| 4,168,533 | 9/1979 | Schwartz | 101/91 |
| 4,246,643 | 1/1981 | Hubbard | 101/91 |
| 4,506,344 | 3/1985 | Hubbard | 101/91 |
| 4,865,139 | 9/1989 | Cohen et al. | 101/324 |
| 5,170,709 | 12/1992 | Jackson et al. | 101/335 |

*Primary Examiner*—Edgar S. Burr
*Assistant Examiner*—John S. Hilten
*Attorney, Agent, or Firm*—Michael I. Kroll

[57] ABSTRACT

A disposable postage stamp marker is provided which consists of a frame and a device carried within the frame, for making a predetermined amount of visible impressions of small official government seals on mail to show that postage has been paid for the mail. An apparatus is carried within the frame and is coupled to the visible impressions making a device for enumerating the predetermined amount of visible impressions that can be made.

5 Claims, 7 Drawing Sheets

(STAMP RETRACTED & DESTROYED AFTER LAST PRESET IMPRESSION)

DISPOSABLE POSTAGE STAMP MARKER

BACKGROUND OF THE INVENTION

1. Field of the Invention

The instant invention relates generally to postage meters and more specifically it relates to a disposable postage stamp marker.

2. Description of the Prior Art

Numerous postage meters have been provided in prior art that are machines used in bulk mailing to print the correct amount of postage on each piece of mail. While these units may be suitable for the particular purpose to which they address, they would not be as suitable for the purposes of the present invention as heretofore described.

SUMMARY OF THE INVENTION

A primary object of the present invention is to provide a disposable postage stamp marker that will overcome the shortcomings of the prior art devices.

Another object is to provide a disposable postage stamp marker that contains a postage stamp imprinter with a porous stamp member to make visible impressions of small official government seals on mail to show that postage has been paid for the mail.

An additional object is to provide a disposable postage stamp marker that after making a predetermined number of visible impressions, a built-in disabler will automatically be activated to deface the porous stamp member and destroy the integrity of the postage stamp imprinter, so that it cannot be used again and must be disposed of.

A still further object is to provide disposable postage stamp marker that has a tamper proof self destruct feature, whereby if someone tries to brake into the marker to get to the postage stamp imprinter the built-in disabler will be activated to deface the porous stamp member.

A further object is to provide a disposable postage stamp marker that is simple and easy to use.

A still further object is to provide a disposable postage stamp marker that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
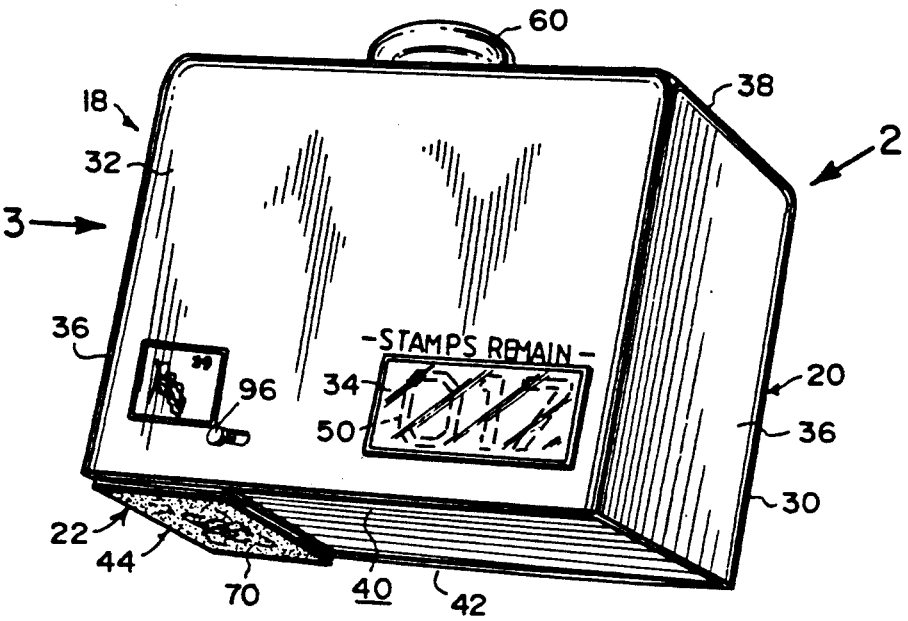
FIG. 1 is a bottom front perspective view of a first embodiment of the instant invention.

Turning now descriptively to the drawings, in which similar reference characters denote similar elements throughout the several views, the Figures illustrate a disposable postage stamp marker 18 which consists of a frame 20 and a device 22 carried within the frame 20 for making a predetermined amount of visible impressions 24 of small official government seals on mail 26, to show that postage has been paid for the mail 26. An apparatus 28 is carried within the frame 20 and is coupled to the visible impressions making device 22, for enumerating the predetermined amount of visible impressions 24 that can be made.

The frame 20 includes a rear wall 30 and a front wall 32 having a window 34 therein. A pair of side walls 36 are also provided, with each extending between the rear wall 30 and the front wall 32. A top wall 38 covers over the rear wall 30, the front wall 32 and the side walls 36, so as to form a chamber 40 therein having an open bottom 42.

The visible impressions making device 22 is a postage stamp imprinter 44 operable through the open bottom 42 from within the chamber 40 in the frame 20. The enumerating apparatus 28 is an electronic module 46 secured within the chamber 40 in the frame 20 and includes a pulse counter 48 activated by the postage stamp imprinter 44 and is programed to a pre-set limit. A visual display unit 50 is connected to the pulse counter 48 and is positioned behind the window 34 in the front wall 32 to indicate remaining visible impressions 24 that can be made.

The frame 20 has a compartment 52 therein. A battery 54 is installed within the compartment 52 to electrically connect to the visual display unit 50 in the electronic module 46. A door 56 is to cover the compartment 52 in the frame 20.

Figure 2:
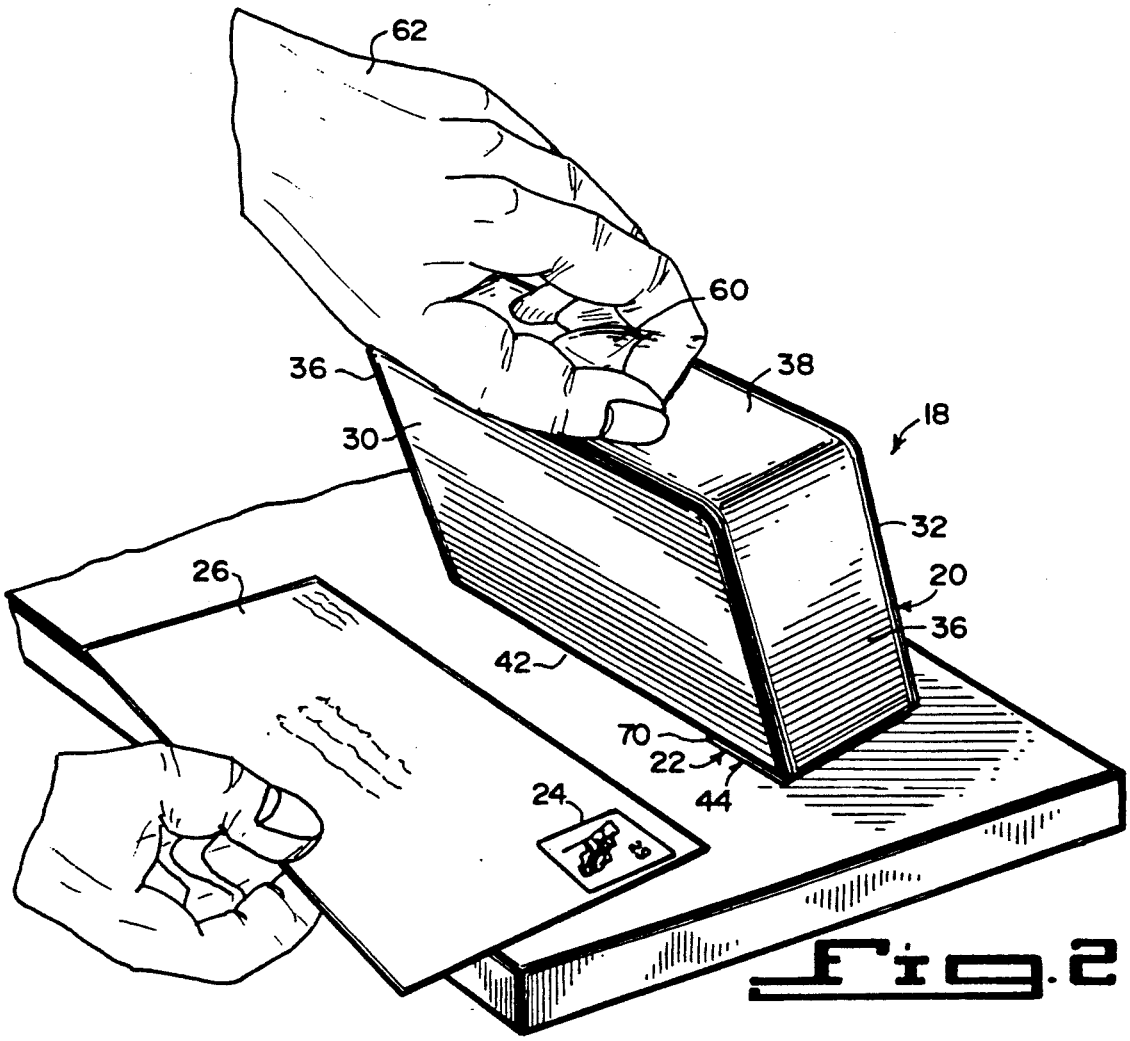
FIG. 2 is a top rear perspective view taken in direction of arrow 2 in FIG. 1, showing the first embodiment being used.
Figure 3:
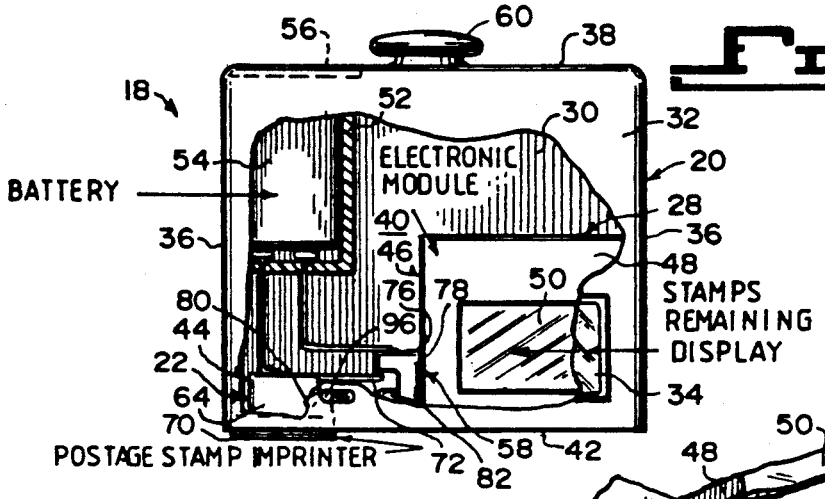
FIG. 3 is a front elevational view taken in direction of arrow 3 in FIG. 1, with the frame broken away.
Figure 4:
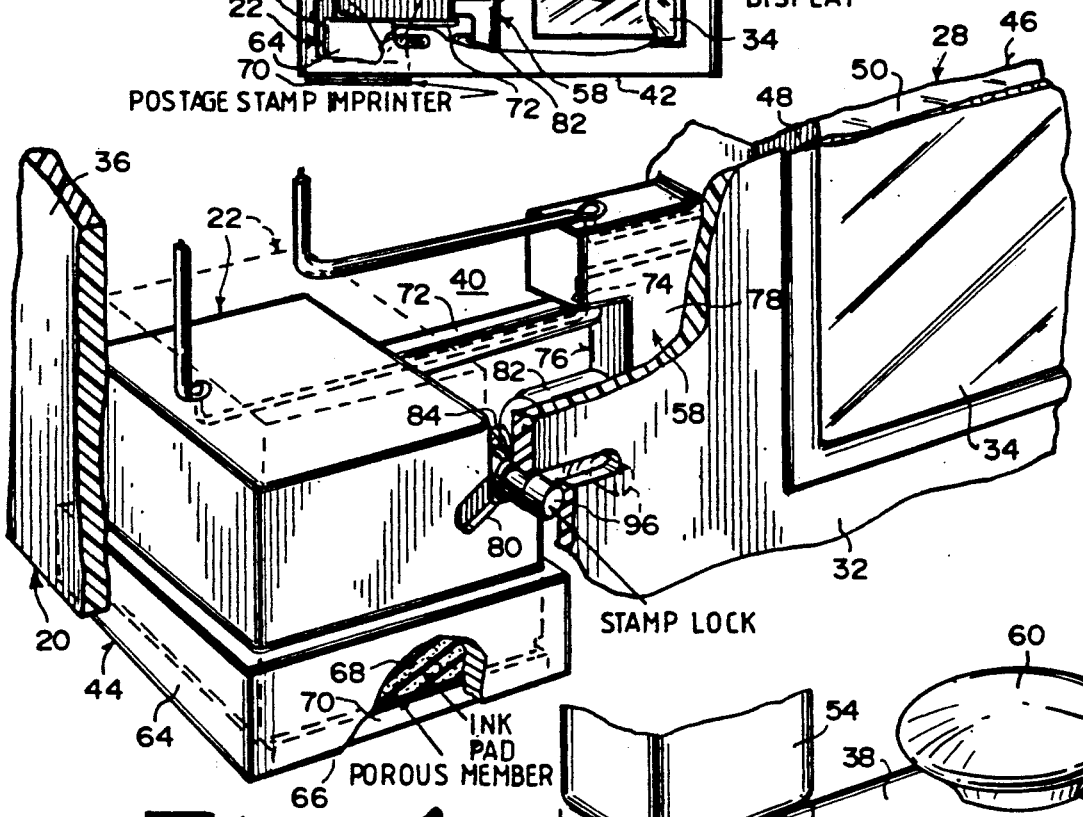
FIG. 4 is an enlarged top front perspective view at the lower left hand corner of FIG. 3, with parts broken away, showing the postage stamp imprinter in greater detail.
Figure 5:
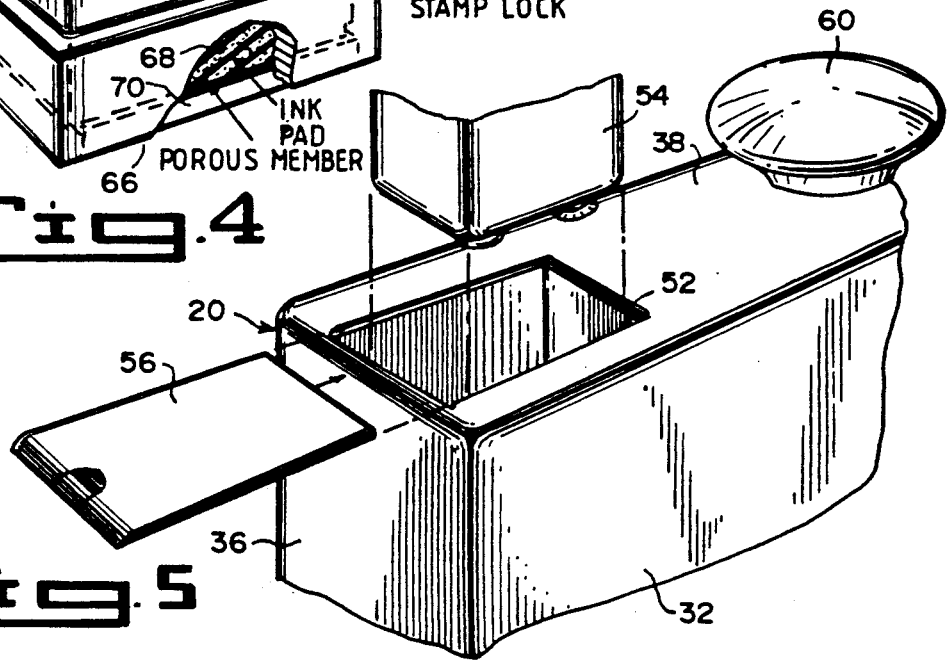
FIG. 5 is an enlarged top front perspective view of the upper left hand corner of FIG. 3, with parts broken away, showing the slide plate and battery exploded from the battery compartment in the frame.
Figure 6:
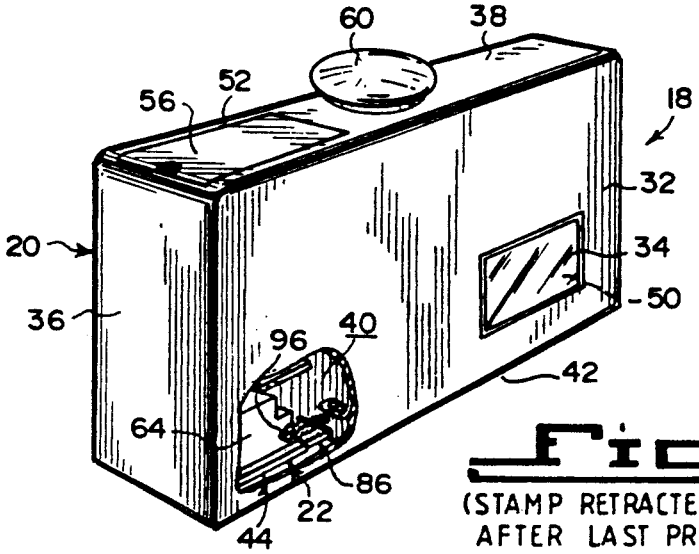
FIG. 6 is a top front perspective view of the first embodiment with parts broken away, showing the postage stamp imprinter retracted and destroyed after the last visible impression was made.
Figure 7:
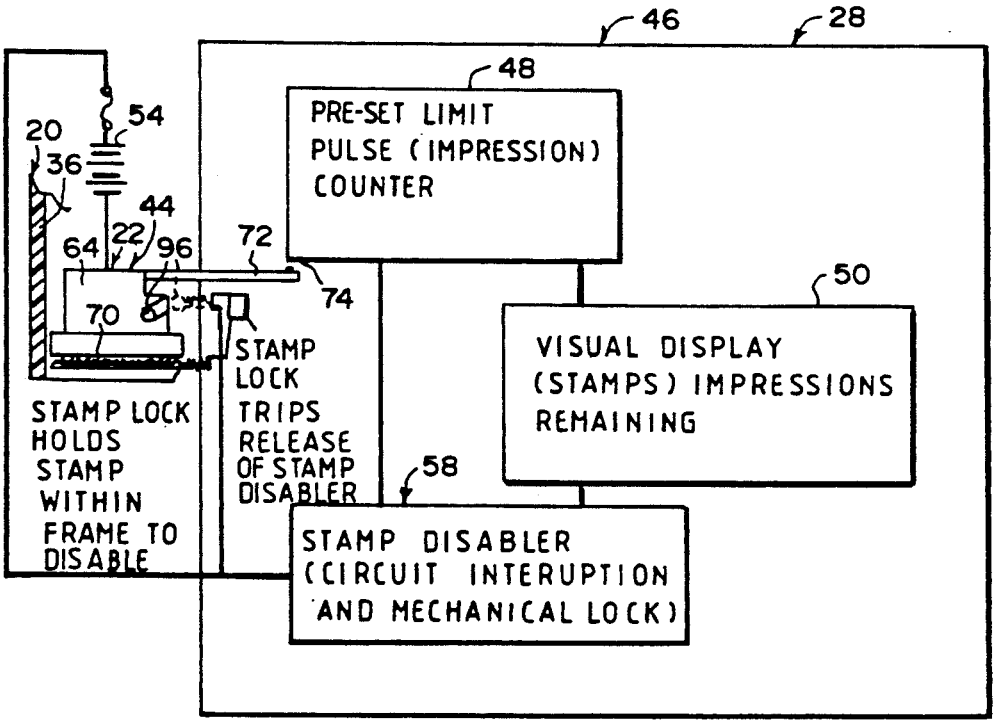
FIG. 7 is a diagrammatic electrical diagram showing the internal components of the electronic module in relationship with the postage stamp imprinted, retracted and destroyed.
Figure 8:
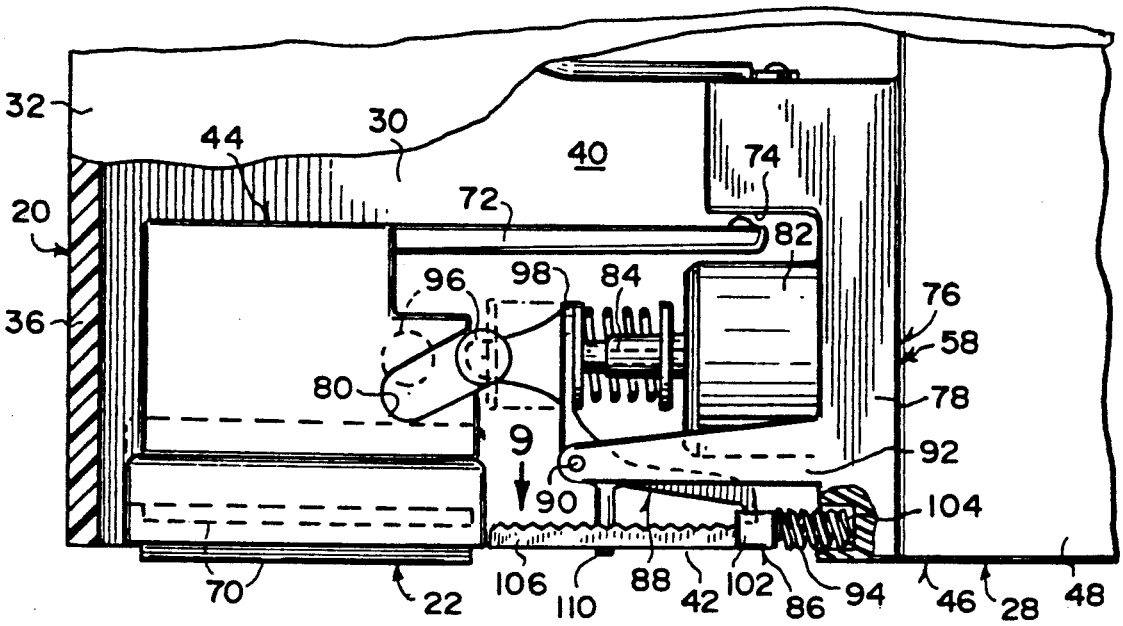
FIG. 8 is an enlarged front elevational view of the lower left hand corner of FIG. 3, with parts broken away, showing the stamp disabler and its associated components in greater detail before actuating.
Figure 9:
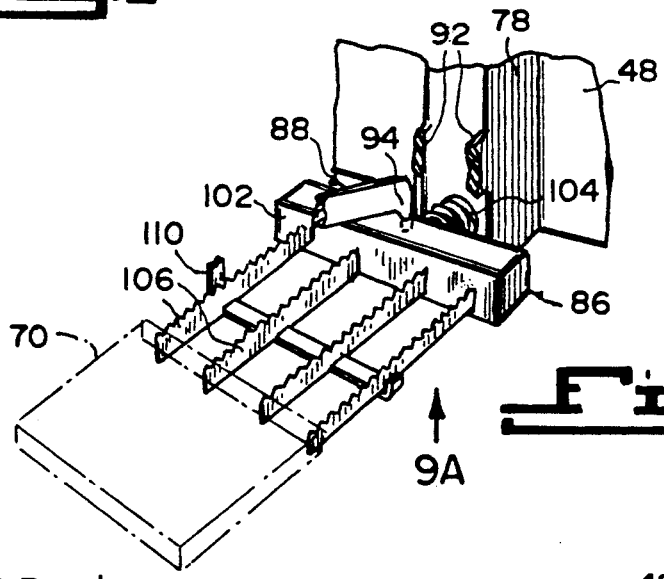
FIG. 9 is a top perspective view taken in direction of arrow 9 in FIG. 8, showing the score making assembly in greater detail.
Figure 9A:
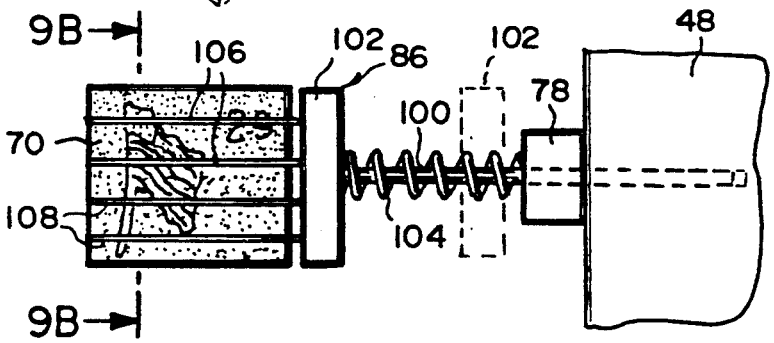
FIG. 9A is a bottom view taken in direction of arrow 9A in FIG. 9, showing the score making assembly after actuating with the saw blades extended across the porous stamp member.
Figure 9B:
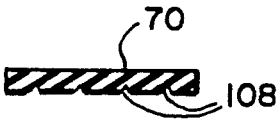
FIG. 9B is a cross sectional view taken along line 9B—9B in FIG. 9A, showing the score lines made in the porous stamp member.

In the first embodiment, shown in FIGS. 1 through 9B, a mechanism 58 is carried within the frame 20 and is coupled between the postage stamp imprinter 44 and the electronic module 46 for automatically preventing operation of the postage stamp imprinter 44, when the pulse counter 48 reaches the pre-set limit. The frame 20 further includes a handle 60 on the top wall 38, so that it can be gripped by a hand 62 of a person using the marker 18.

The postage stamp imprinter 44 contains a housing 64, having an open bottom end 66 and is movable and carried within a lower portion of the chamber 40 of the frame 20. An ink pad 68 is carried within the housing 64. A porous stamp member 70 is applied to the underside of the ink pad 68 at the open bottom end 66 of the housing 64, whereby the porous stamp member 70 will extend just below the open bottom 42 of the frame 20. A contact arm 72 extends from a side of the housing 64 and is electrically connected to the battery 54. A contact member 74 is on the electronic module 46. When the visual impression 24 is made by the porous stamp member 70, the housing 64 will move inwardly within the chamber 40 of the frame 20 to allow the contact arm 72 to engage with the contact member 74 and activate the pulse counter 48.

The operation preventing mechanism 58 is a disabler 76, having a casing 78 secured to one side of the electronic module 46 and includes the housing 64 of the postage stamp imprinter 44 having a downwardly angled slot 80 in a side facing the electronic module 46. A solenoid 82 is connected to the casing 78 of the disabler 76 and has a normally collapsed spring biased telescopic arm 84 facing the housing 64. The telescopic arm 84 will extend from the solenoid 82, when the disabler 76 is activated. A spring biased score marking assembly 86 is connected to the casing 78 of the disabler 76 in a spaced relationship under the solenoid 82.

A locking pall 88 is pivotally connected at a first end 90 and extended portion 92 of the casing 78 of the disabler 76 between the solenoid 82 and the score marking assembly 86. A second end 94 of the locking pall 88 being hooked, will normally retain the score marking assembly 86 in a compressed position against the casing 78 of the disabler 76. A stamp lock 96 having a downwardly extending leg 98 connected to the first end 90 of the locking pall 88 is located at a distal end of the telescopic arm 84 of the solenoid 82. When the telescopic arm 84 of the solenoid 82 is extended, the stamp lock 94 will ride within the downwardly angled slot 80 in the housing 64 of the postage stamp imprinter 44 to raise the housing 64 into the chamber 40 of the frame 20, causing the second end 94 of the locking pall 88 to release the score marking assembly 86 and move directly under the porous stamp member 70 to destroy the integrity of the postage stamp imprinter 44.

The locking pall 88 is also a tamper proof self destruct feature within the disposable postage stamp marker 18. If someone tries to brake into the frame 20 to get to the postage stamp imprinter 44, the score marking assembly 86 will be released by the dislodgment of the locking pall 88 to deface the porous stamp member 70.

The score marking assembly 86 includes a shaft 100 slideable within the casing 78 of the disabler 76. A cross bar 102 is mounted transversely at a first side to a free end of the shaft 100. A spring 104 on the shaft 100 is between the casing 78 of the disabler 76 and the cross bar 102. A plurality of parallel spaced apart saw blades 106 extend from a second side of the cross bar 102, which will produce score lines 108 on a face of the porous stamp member 70, so as to prevent continued use of the porous stamp member. A bracket 110 extends downwardly from the extended portion 92 of the casing 78 and under the saw blades 106, so as to guide and support the saw blades 106 when the score marking assembly 86 is released.

Figure 10:
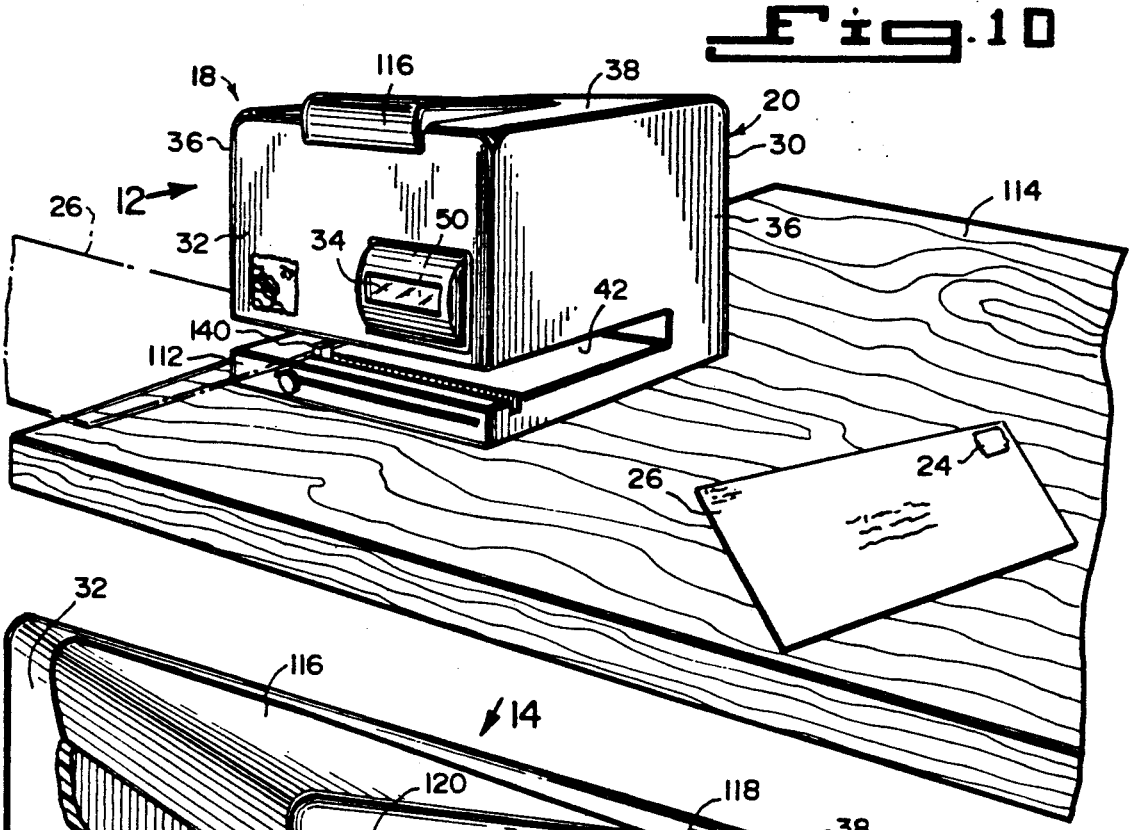
FIG. 10 is a top front perspective view of a second embodiment of the instant invention being used.
Figure 11:
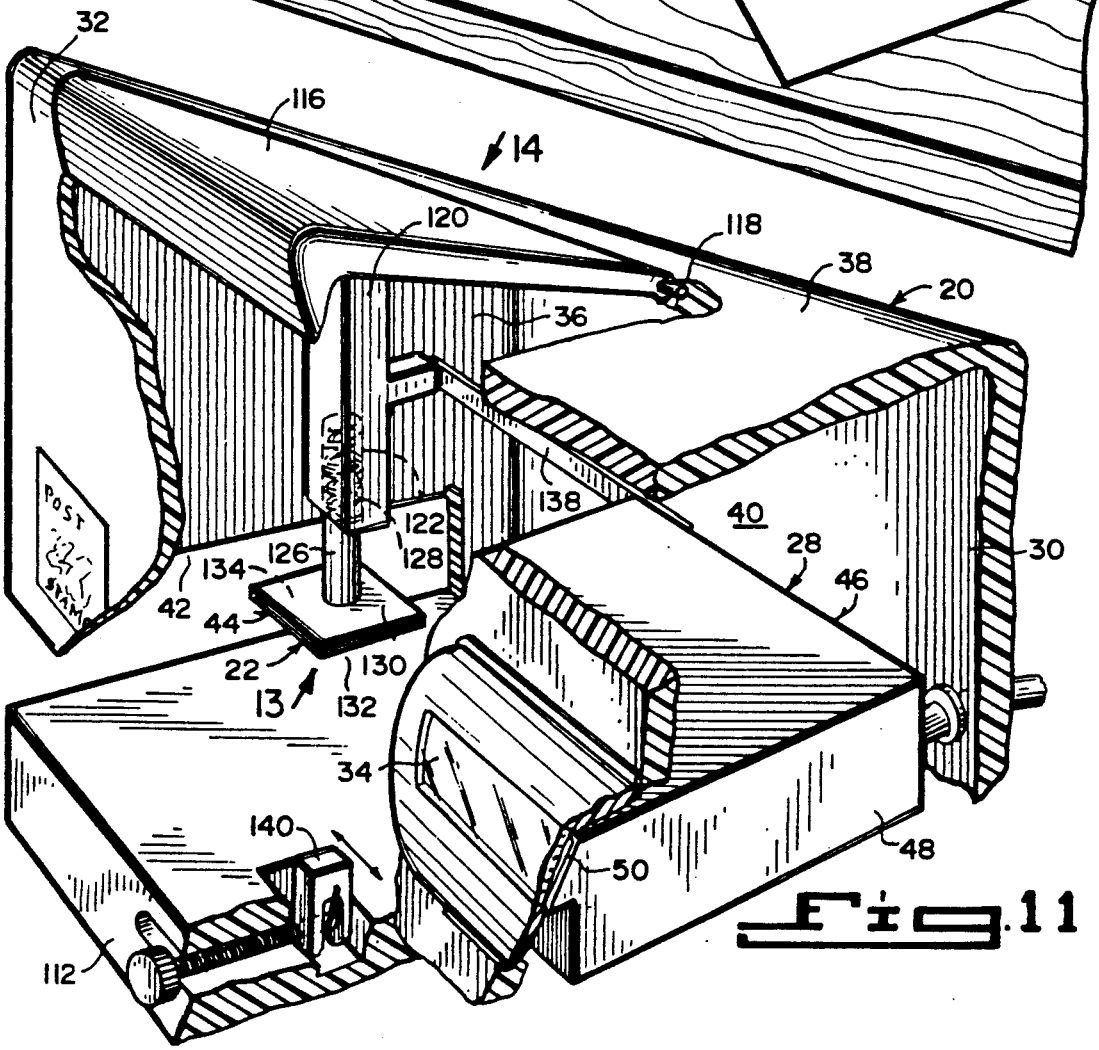
FIG. 11 is an enlarged top front perspective view of the second embodiment with the frame broken away showing the various elements therein.
Figure 12:
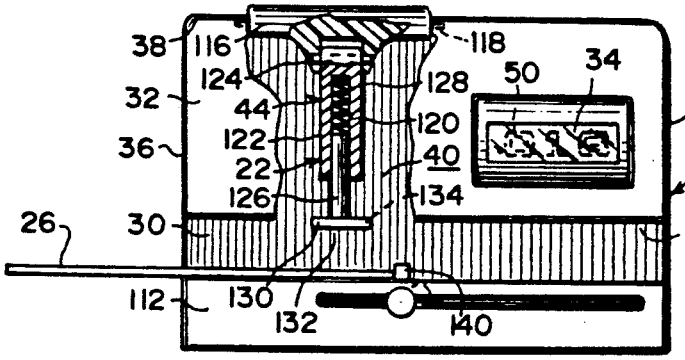
FIG. 12 is a front elevational view taken in direction of arrow 12 in FIG. 10, with parts broken away.
Figure 13:
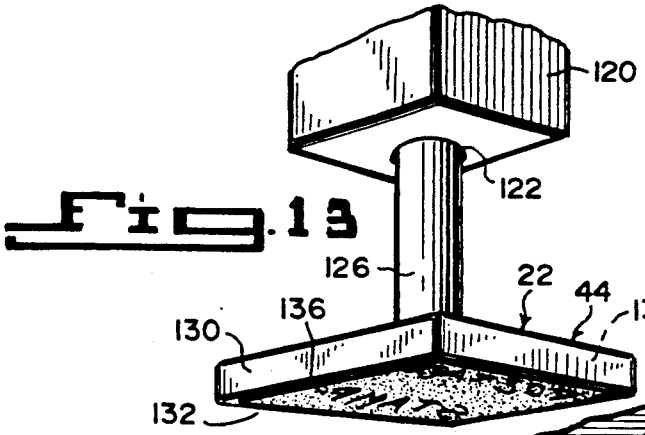
FIG. 13 is a bottom front perspective view of a lower portion of the postage stamp imprinter taken in direction of arrow 13 in FIG. 11.
Figure 14:
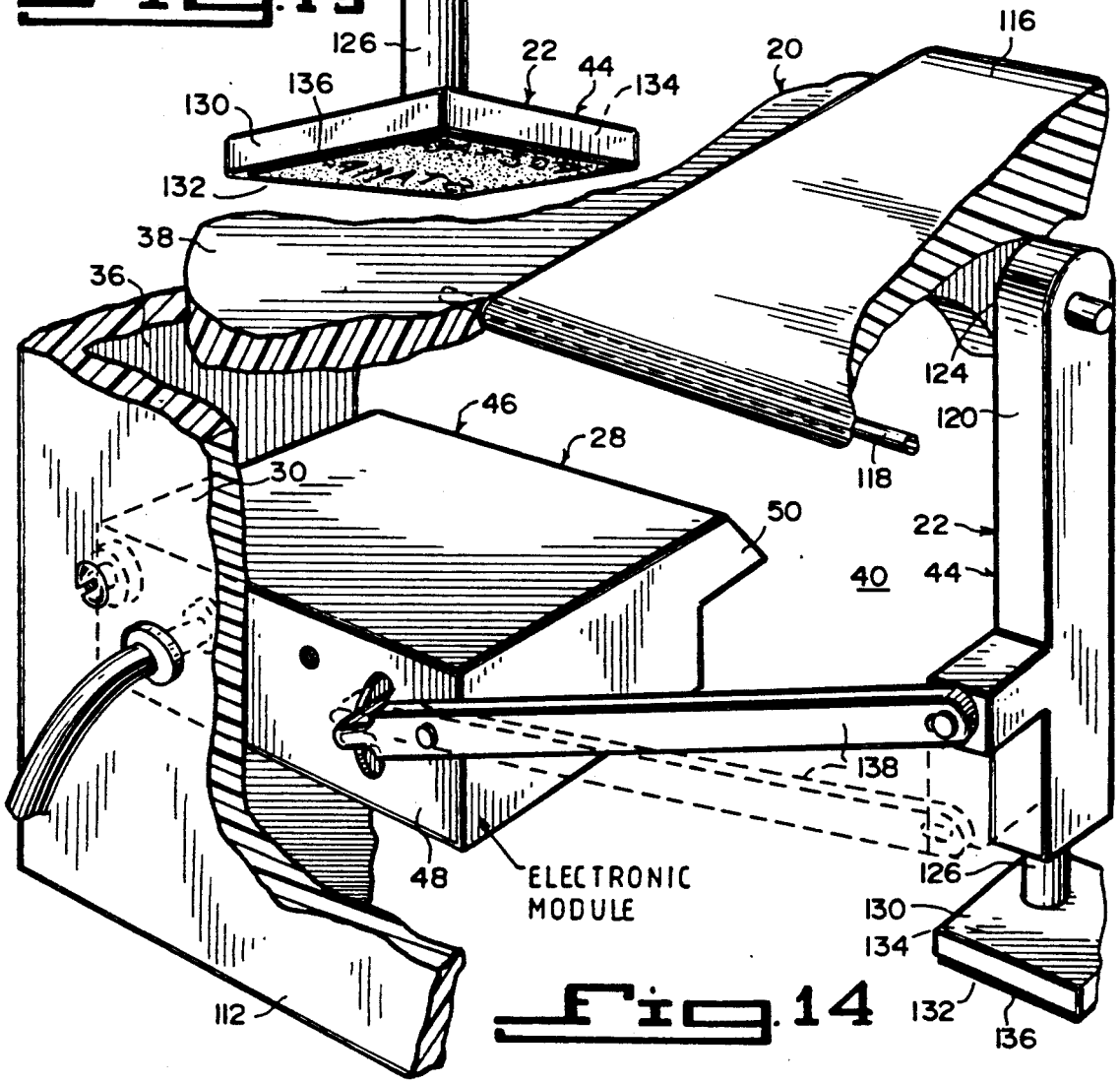
FIG. 14 is a top rear perspective view taken in direction of arrow 14 in FIG. 11 with parts broken away.
Figure 15:
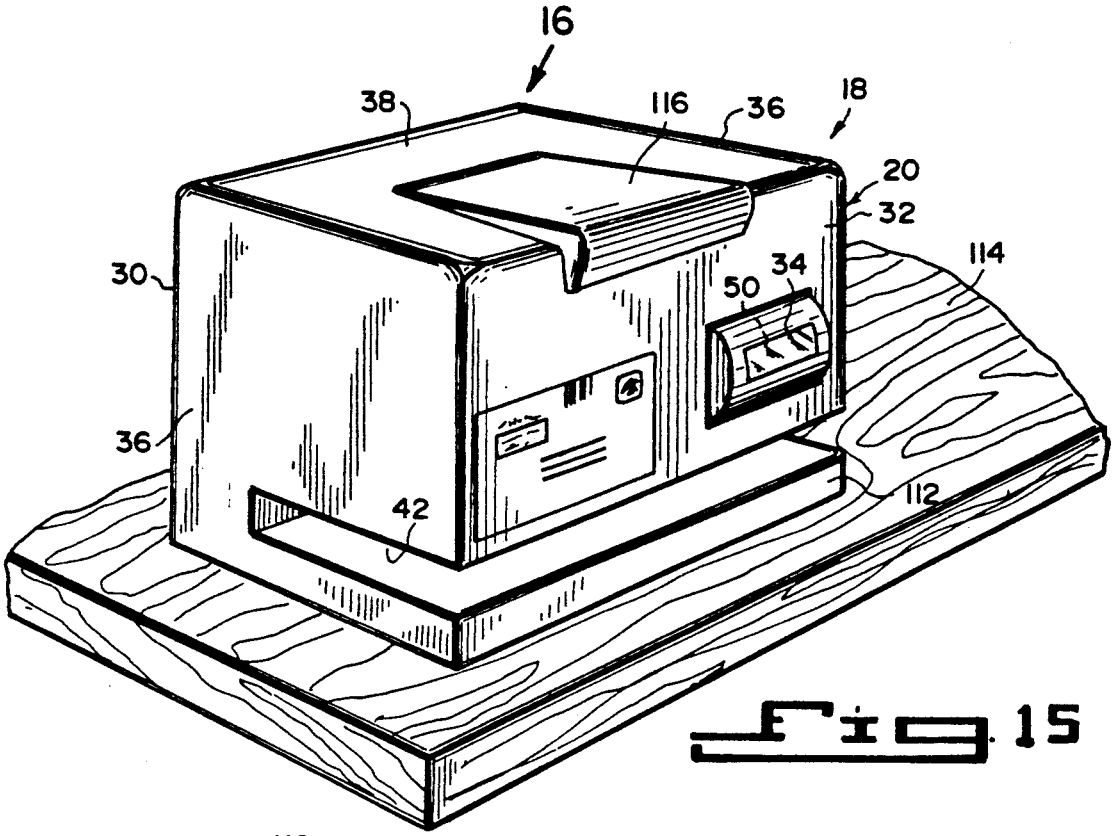
FIG. 15 is a top front perspective view of a modified second embodiment.
Figure 16:
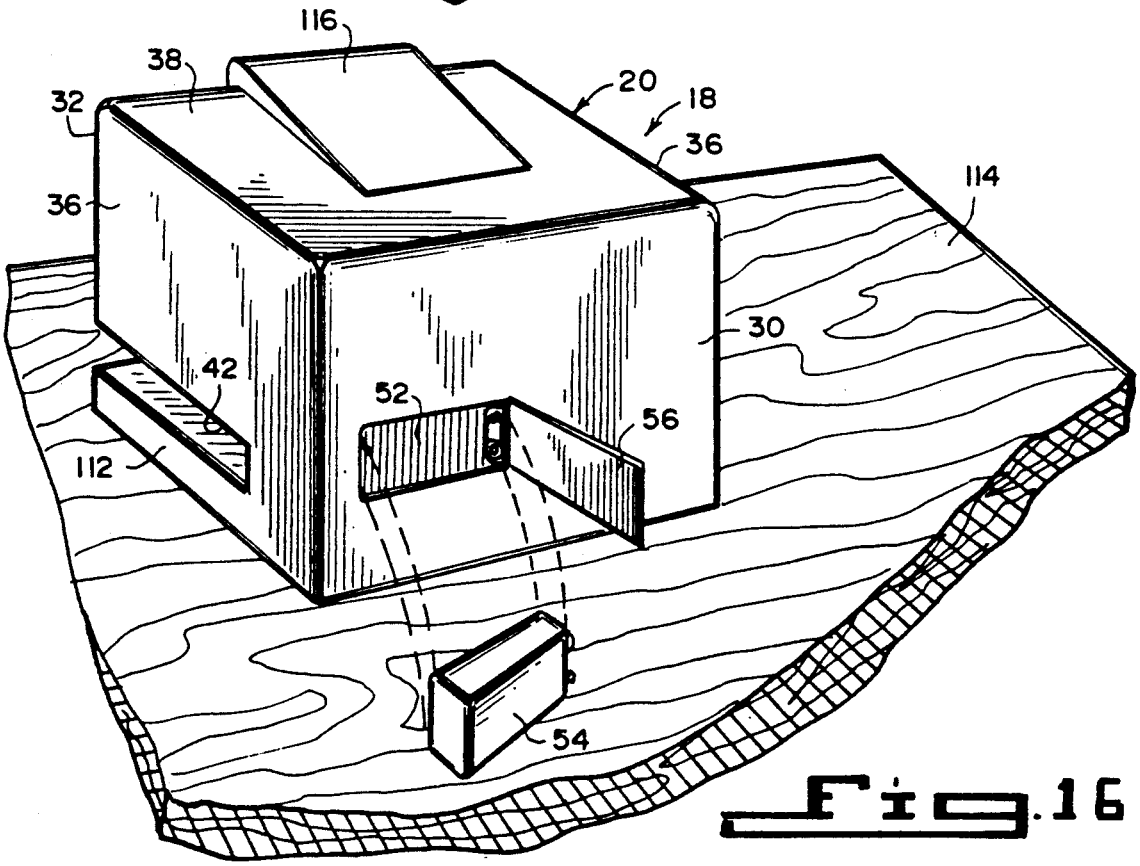
FIG. 16 is a top rear perspective view taken in direction of arrow 16 in FIG. 15, showing the installation of a battery within the battery compartment in the frame.

FIGS. 10 through 16 show a second embodiment, wherein the frame 20 further includes a base 112 extending under the open bottom 42, so that the frame 20 can sit upon a flat surface 114. The postage stamp imprinter 44 contains an operable handle 116 pivotally mounted at 118 into the top wall 38, so that it can be depressed by a hand of a person. A stanchion 120 has a bore 122 in a lower end and is pivotally mounted at an upper end 124 to an underside of the handle 116, so as to extend downwardly therefrom. A leg 126 slideably extends outwardly from within the bore 122 in the bottom end of the stanchion 120. A compression spring 128 is within the bore 122 to engage with the leg 126. A housing 130 has an open bottom end 132 and is connected at its top end to a distal end of the leg 126. An ink pad 134 is carried within the housing 130. A porous stamp member 136 is applied to the underside of the ink pad 134 at the open bottom end 132 of the housing 130. A rod 138 is pivotally connected between the stanchion 120 and the electronic module 46, so that when a visual impression 24 is made by the porous stamp member 136, the rod 138 will mechanically operate the pulse counter 48.

The disposable postage stamp marker 10 can further include an adjustable stop member 140 mounted within the base 112, so that the mail 26 can be properly positioned under the postage stamp imprinter 44.

LIST OF REFERENCE NUMBERS

| | |
|---|---|
| 18 | disposable postage stamp marker |
| 20 | frame |
| 22 | visible impressions making device |
| 24 | visible impression |
| 26 | mail |
| 28 | enumerating apparatus |
| 30 | rear wall of 20 |
| 32 | front wall of 20 |
| 34 | window in 32 |
| 36 | side wall of 20 |
| 38 | top wall of 20 |
| 40 | chamber in 20 |
| 42 | open bottom of 40 |
| 44 | postage stamp imprinter for 22 |
| 46 | electronic module for 28 |
| 48 | pulse counter of 46 |
| 50 | visual display unit of 46 |
| 52 | compartment in 20 |
| 54 | battery |
| 56 | door |
| 58 | operation preventing mechanism |
| 60 | handle on 38 |
| 62 | hand of a person |

-continued

| LIST OF REFERENCE NUMBERS | |
|---|---|
| 64 | housing of 44 |
| 66 | open bottom end of 64 |
| 68 | ink pad of 44 |
| 70 | porous stamp member of 44 |
| 72 | contact arm on 64 |
| 74 | contact member on 46 |
| 76 | disabler for 58 |
| 78 | casing of 76 |
| 80 | downwardly angled slot in 64 |
| 82 | solenoid |
| 84 | spring biased telescopic arm of 82 |
| 86 | spring biased score marking assembly |
| 88 | locking pall |
| 90 | first end of 88 |
| 92 | extended portion of 78 |
| 94 | second end of 88 |
| 96 | stamp lock |
| 98 | leg of 96 |
| 100 | shaft of 86 |
| 102 | cross bar of 86 |
| 104 | spring on 100 |
| 106 | saw blade of 86 |
| 108 | score line |
| 110 | bracket |
| 112 | base of 20 |
| 114 | flat surface |
| 116 | operable handle of 44 |
| 118 | pivot between 38 and 116 |
| 120 | stanchion |
| 122 | bore in 120 |
| 124 | pivot between 116 and 120 |
| 126 | leg in 122 |
| 128 | compression spring in 122 |
| 130 | housing |
| 132 | open bottom end of 130 |
| 134 | ink pad |
| 136 | porous stamp member |
| 138 | rod between 46 and 120 |
| 140 | adjustable stop member in 112 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A disposable postage stamp marker which comprises:

a) a frame;

b) means carried within said frame, for making a predetermined amount of visible impressions of small official government seal on mail to show that postage has been paid for the mail; and c) means carried within said frame and coupled to said visible impressions making means, for enumerating the predetermined amount of visible impressions that can be made; said frame includes:

a rear wall;

a front wall having a window therein;

a pair of side walls, each extending between said rear wall and said front wall; and a top wall covering over said rear wall, said front wall and said side walls, so as to form a chamber therein having an open bottom;

said visible impression making means is a postage stamp imprinter operable through the open bottom from within the chamber in said frame;

said enumerating means is an electronic module secured within the chamber in said frame and includes:

a pulse counter activated by said postage stamp imprinter and programmed to a pre-set limit; and a visual display unit connected to said pulse counter and positioned behind the window in said front wall, to indicate remaining visible impressions that can be made;

said frame having a compartment therein;

a battery installed within said compartment to electrically connect to said visual display unit in said electronic module;

and a door to cover said compartment in said frame;

said frame further includes a base extending under the open bottom, so that said frame can sit upon a flat surface;

an operable handle pivotally mounted into said top wall, so that it can be depressed by a hand of a person;

a stanchion having a bore in a lower end and pivotally mounted at an upper end to an underside of said handle, so as to extend downwardly therefrom;

a leg slideably extending outwardly from with the bore in the bottom end of said stanchion;

a compression spring within said bore to engage with said leg;

a housing having an open bottom end and connected at its top end to a distal end of said leg;

an ink pad carried within said housing;

a porus stamp member applied to the underside of said ink pad at the open bottom end of said housing; and a rod pivotally connected between said stanchion and said electronic module, so that when a visual impression is made by said porous stamp member, said rod will mechanically operate said pulse counter.

2. A disposable postage stamp marker as recited in claim 1, further including an adjustable stop member mounted within said base, so that the mail can be properly positioned under said postage stamp imprinter.

3. A disposable postage stamp marker as recited in claim 1, further including means carried within said frame and coupled between said postage stamp imprinter and said electronic module, for automatically preventing operation of said postage stamp imprinter when said pulse counter reaches the pre-set limit.

4. A disposable postage stamp marker as recited in claim 3, wherein said operation preventing means is a disabler having a casing secured to one side of said electronic module and includes:

a) said housing of said postage stamp imprinter having a downwardly angled slot in a side facing said electronic module;

b) a solenoid connected to said casing of said disabler and having a normally collapsed spring biased telescopic arm facing said housing, in which said telescopic arm will extend from said solenoid when said disabler is activated;

c) a spring biased score marking assembly connected to said casing of said disabler in a spaced relationship under said solenoid;

d) a locking pall pivotally connected at a first end to an extended portion of said casing of said disabler, between said solenoid and said score marking assembly, whereby a second end of said locking pall being hooked will normally retain said score marking assembly in a compressed position against said casing of said disabler; and e) a stamp lock having a downwardly extending leg connected to said first end of said locking pall located at a distal end of said telescopic arm of said solenoid, so that when said telescopic arm of said solenoid is extended said stamp lock will ride within said downwardly angled slot in said housing of said postage stamp imprinter to raise said housing into the chamber of said frame, causing said second end of said locking pall to release said score marking assembly and move directly under said porous stamp member to destroy the integrity of said postage stamp imprinter.

5. A disposable postage stamp marker as recited in claim 4, wherein said score marking assembly includes:

a) a shaft slideable within said casing of said disabler;

b) a cross bar mounted transversely at a first side to a free end of said shaft;

c) a spring on said shaft between said casing of said disabler and said cross bar;

d) a plurality of parallel spaced apart saw blades extending from a second side of said cross bar which will produce score lines on a face of said porous stamp member, so as to prevent continued use of said porous stamp member; and e) a bracket extending downwardly from said extended portion of said casing and under said saw blades, so as to guide and support said saw blades when said score marking assembly is released.

* * * * *